US006736242B2

(12) United States Patent
Nygren

(10) Patent No.: US 6,736,242 B2
(45) Date of Patent: May 18, 2004

(54) SAFETY ARRANGEMENT FOR A HOIST

(75) Inventor: Gunnar Nygren, Bureä (SE)

(73) Assignee: Alimak AB, Skellefteå (SE)

( * ) Notice: Subject to any disclaimer, the term of this patent is extended or adjusted under 35 U.S.C. 154(b) by 77 days.

(21) Appl. No.: 10/002,392

(22) Filed: Nov. 2, 2001

(65) Prior Publication Data

US 2002/0084148 A1 Jul. 4, 2002

(30) Foreign Application Priority Data

Nov. 2, 2000 (SE) ..... 0004011

(51) Int. Cl.[7] ..... B66B 5/00; B66B 5/16
(52) U.S. Cl. ..... 187/357; 187/356; 187/302
(58) Field of Search ..... 187/282, 302, 187/357, 343, 344

(56) References Cited

U.S. PATENT DOCUMENTS

| | | | | |
|---|---|---|---|---|
| 5,727,657 A | | 3/1998 | Foelix | |
| 5,773,771 A | * | 6/1998 | Chatham | 187/282 |
| 5,806,633 A | * | 9/1998 | Macuga | 187/357 |
| 6,138,798 A | * | 10/2000 | Macuga | 187/294 |
| 6,481,534 B1 | * | 11/2002 | Malone, Jr. | 187/377 |

FOREIGN PATENT DOCUMENTS

| | | |
|---|---|---|
| EP | 0 129 678 B1 | 8/1987 |
| WO | 99/47447 | 9/1999 |

* cited by examiner

*Primary Examiner*—Eileen D. Lillis
*Assistant Examiner*—Thuy v. Tran
(74) *Attorney, Agent, or Firm*—Ware, Fressola, Van der Sluys & Adolphson LLP

(57) ABSTRACT

An arrangement for a hoist secures safety zones in case persons should be outside the hoist cage in a hoist shaft. The arrangement can identify risk situations and includes mechanical limitation devices that can enter into the path of the hoist cage. The limitation devices are arranged at a distance from the upper and lower end limits of the hoist cage during normal operation in order to form upper and lower safety end limits, thereby mechanically securing the safety zones. Striking surfaces are arranged to tilt between an inactive state outside the path of the hoist cage and an active state in the path of the hoist cage forming the safety end limits. The striking surfaces are balanced so that they strive to take their respective active states. A retaining device is arranged on each striking surface to keep the striking surfaces in an inactive state during normal operation and to release the striking surfaces in a risk situation so that it takes its respective active state.

5 Claims, 6 Drawing Sheets

SAFETY ARRANGEMENT FOR A HOIST

BACKGROUND OF THE INVENTION

1. Technical Field

The present invention concerns a safety arrangement for hoists having a hoist cage adapted to travel in a path in a hoist shaft. The arrangement secures safety zones in case persons should be outside the hoist cage in the hoist shaft.

2. Description of the Background Art

Demands on safety zones above and below hoist cages have been made more stringent during recent years and further restrictions are expected. These new demands can usually be met by new installations but increasing the depth and/or raising the roof on existing hoist shafts is often impossible in practice.

These conditions have resulted in the use of known technology to create solutions in which electronic control systems for hoists interact with some form of mechanical safety device, often in the form of manual extendable support being arranged to abut either the hoist cage directly or particular surfaces on the hoist cage through inelastic engagement.

For example, WO 99/47447 illustrates an arrangement in which the mechanical safety device comprises a tilting support, which in a tilted down passive position is located flat on the shaft floor, allowing normal hoist cage operation, and in a tilted up active vertical position has its free upward facing end intended to abut against a downward moving hoist cage, thereby ensuring a safety zone and putting the hoist in a second operating position for service and maintenance. The position of the support must be changed manually by the operator from inside the shaft.

It would be preferable to have guaranteed safety zones in all situations where it is possible for a person to enter the shaft outside the hoist cage for service, maintenance, repair, inspection, forced entry, etc. To guarantee this state, it should be virtually impossible to enter the hoist shaft outside the hoist cage without the hoist being in position for service and the safety zone being secured.

SUMMARY OF THE INVENTION

One object of the present invention is to alleviate or even overcome the aforesaid failings in known techniques.

These and other objects, distinctive features and advantages with the invention will be evident in the dependent patent claims and the following detailed description of a preferred embodiment of the invention. This embodiment constitutes a specimen and accordingly does not limit the scope of protection of the invention.

BRIEF DESCRIPTION OF THE DRAWINGS

References to attached drawings, in which equivalent or similar components have been given the same reference designation, have been inserted in the text to facilitate comprehension.

DETAILED DESCRIPTION OF THE INVENTION

Special expressions and designations of component parts have been used in the following detailed description for reasons of clarity of the embodiments. These expressions and designations shall consequently not be interpreted as limitations for the scope of protection of the invention but as examples within it.

Figure 1:
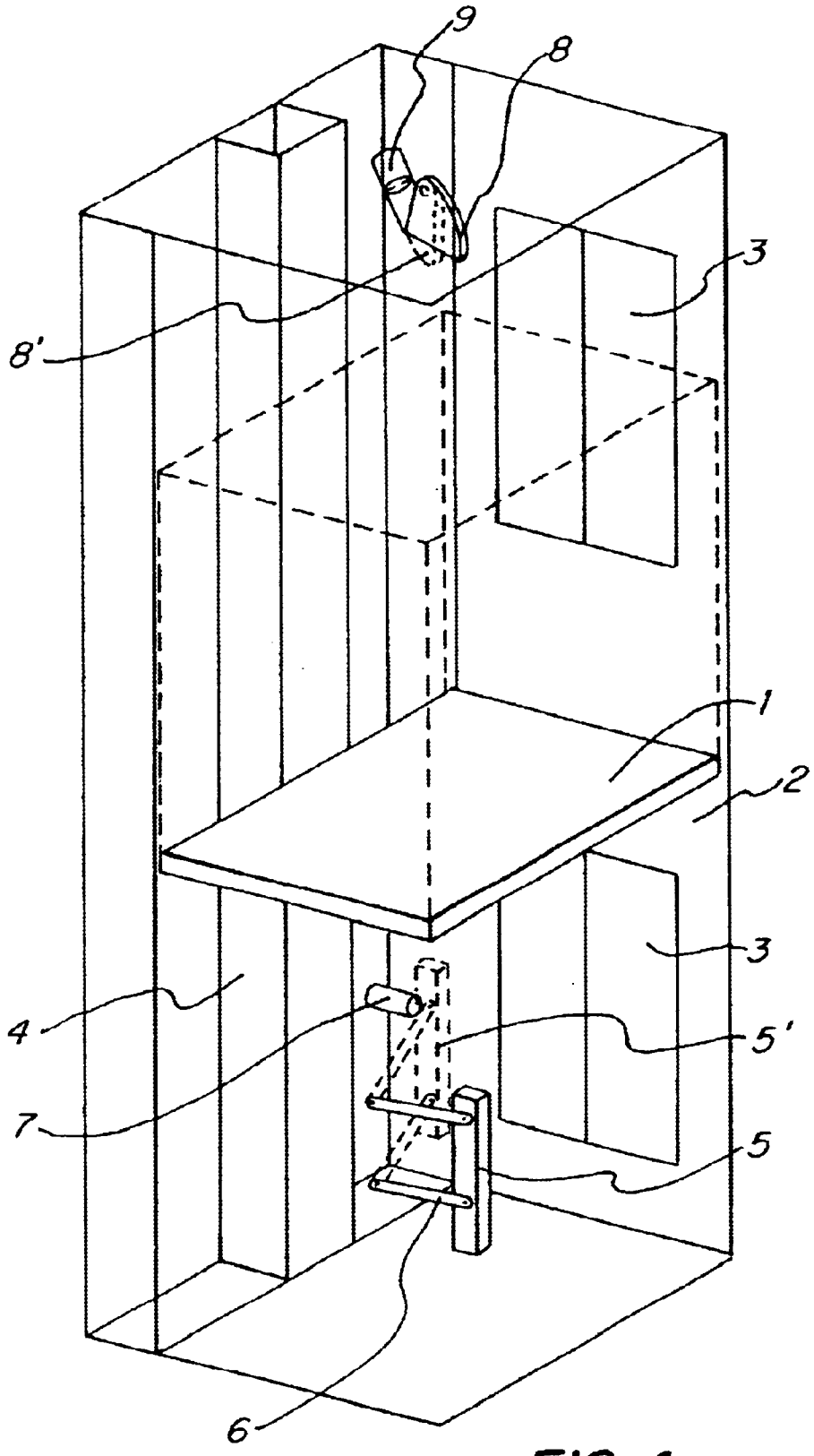
FIG. 1 illustrates a schematic of a hoist in a hoist shaft with an arrangement according to an embodiment of the present invention.

With reference to FIG. 1, a hoist cage 1 arranged in a hoist shaft 2 with doors 3 at different stopping points (e.g. floors) is illustrated schematically. For reasons of simplicity, only two stopping points are illustrated but it should be understood that between the top and bottom stopping points there can be an additional one or more stopping points.

The operation of the hoist takes place through the interaction of a drive unit 4, e.g. a hydraulic unit, rack and pinion system or other known unit intended for operating hoists, and a control system for the drive unit and for assisting auxiliary functions such as door operation, etc. The control system is initiated e.g. by pushbuttons by the door or in the hoist cage and control the movement of the hoist cage 1, operation of the doors 3, etc.

Furthermore, integrated in the said control system or in a special control system is a means of identifying safety situations, e.g. if a door 3 is open without the hoist cage fully surrounding the opening and preventing access to the hoist shaft. If this should occur, a safety zone under the hoist cage and a safety zone above the hoist cage must immediately be secured in the hoist shaft.

Once the hoist has entered safety operation mode, e.g. for service, inspection, forced door entry, etc., the mechanical means of limitation according to a preferred embodiment of the present invention must be released and block the movement of the hoist, one above and/or one below the hoist cage. Since the mechanical means of limitation are arranged unstably in their respective inactive states, they will enter an active state after the said releasing action. Through additionally arranging the means of securement so that they will be released also in case of a power cut to the systems, the risk of a door being opened during a power cut to gain access to the hoist shaft under the hoist cage will be eliminated without the safety zone being mechanically secured.

With reference to FIG. 1, such a means of limitation intended to secure a safety zone under the hoist cage can comprise a vertical leg 5. The leg 5 is arranged so that it can be moved between active state 5, standing on the floor of the hoist shaft and extending upwards in the direction of the hoist cage in order to abut against the hoist cage 1 with its free end, and an inactive and contracted position 5', arranged by the side of the path of the hoist cage in the hoist shaft.

The length of the leg 5 is chosen so that the safety zone is sufficient when the hoist cage is resting on the leg.

Furthermore, the arrangement can include one or more legs arranged under the hoist cage around or by one side of the shaft.

In the illustrated embodiment, the leg 5 is mounted on two parallel arms 6, which extend horizontally from their respective attachments outside the path of the hoist cage when the leg is in an active state to thereby in combination with the leg reach sufficiently into the path of the hoist cage.

The arms 6 are furthermore arranged to tilt at the side of the shaft, e.g. on one wall of the shaft or by a pillar along which the hoist cage runs, so that when the leg is being withdrawn to its contracted state 5', they tilt up to raise the leg in an arced movement but still, however, with its extension length in parallel with the direction of travel of the hoist cage. The tilting movement of the arms 6 is limited so that together with the mounted leg in a raised state, they are still unstable, whereby striving to return to the leg's active state 5. In one embodiment, this means that the arms do not tilt far enough to pass their vertical plane.

As the leg 5 in its contracted state also extends in parallel to the direction of movement of the hoist cage and the extent of the hoist shaft, only a minimum of space is required to raise the leg and, which is important, no special space is required beneath the hoist cage.

In order to retain the leg 5' in its contracted state, there is a retaining device arranged to hold the leg in its contracted state until a risk situation arises.

In the present embodiment, the retaining device is an electromagnet 7. Should the hoist with drive and control systems lose its power supply, the electric magnet will then lose its retaining power and the leg will take its active state 5 due to its own weight, securing the required safety zone.

The upper means of limitation in the present embodiment is a tilting projection 8 arranged on one wall of the shaft. The projection 8 is stably suspended and so designed and balanced that when inactive, it extends into the path of the hoist cage, thereby preventing its movement. By selecting the distance from the roof of the shaft that the projection 8 is arranged, the safety zone above the hoist cage 1 can be secured. The projection 8 is also balanced so that it is unstable in a contracted state. A retaining device, such as an electromagnet 9, is arranged to keep the projection in an inactive state 8' at the side of the path of the hoist during normal operation.

The upper retaining device may well be governed simultaneously and on the same circuit as the aforesaid lower retaining device 7.

The means of limitation furthermore may well comprise a surface for interacting with a limit switch on the hoist cage or a limit switch for interacting with a surface on the hoist cage. The object is that when the means of limitation are in an active state, the drive will be shut off to the hoist cage as it approaches them. Hereby, a hoist cage will not hit a stable means of limitation at full speed but will stop just before contact is made.

The means of limitation can furthermore be equipped with a buffer to dampen the jolt in case a hoist cage should hit the means of limitation with full force. Such a buffer can be arranged on the hoist cage, in the hoist shaft or on the means of limitation, on top or underneath it, or be integrated in the means of limitation between its upper and lower stop surfaces.

Buffers are usually arranged on the bottom of the shaft in the unlikely event that a hoist cage should crash to the floor. In such a case, the lower mechanical means of limitation shown in the embodiment illustrated in FIG. 1 could in another version be arranged in an active state to be brought to rest on such a buffer 10 instead of against the bottom of the shaft. This is shown schematically in FIGS. 2 and 3.

Figure 2:
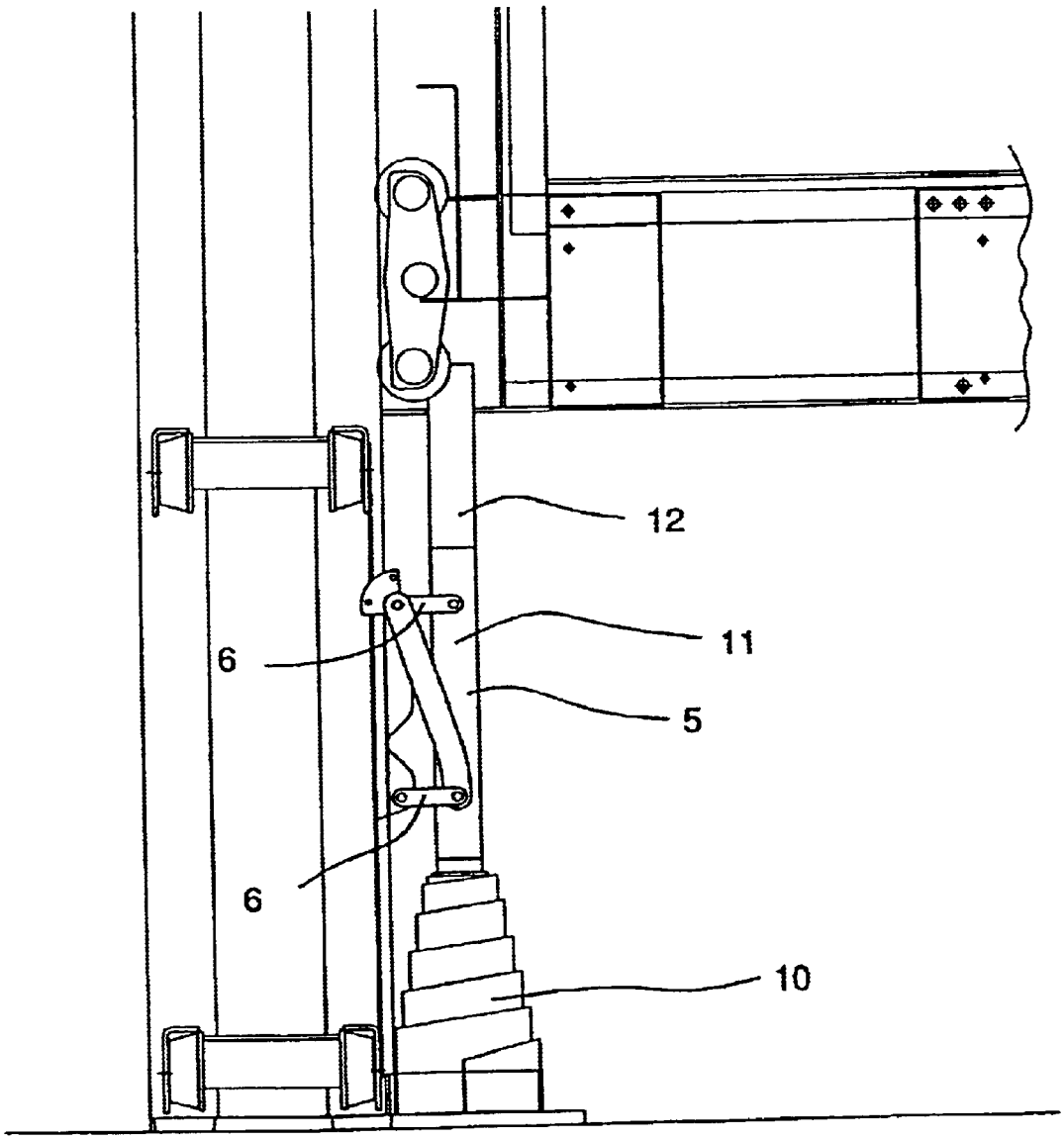
FIGS. 2 and 3 illustrate part of the preferred embodiment of the arrangement according to the present invention.
Figure 3:
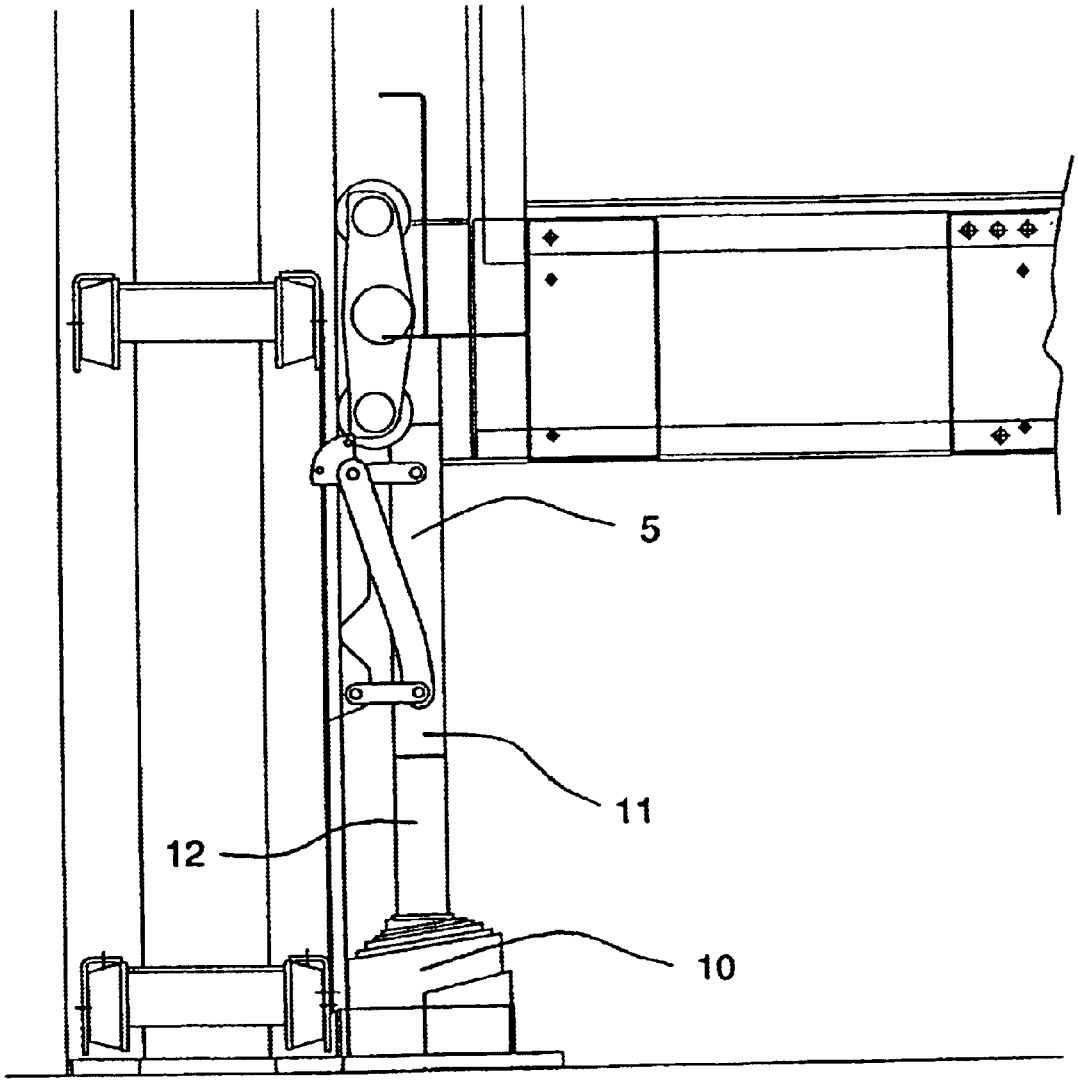

The leg 5 in the embodiment illustrated in FIGS. 2 and 3 is arranged in active state to rest against a shock absorbing surface, which is consequently deformable. For this reason, the leg 5 exhibits an almost sleeve-shaped retaining part 11 and a shock absorbing part 12 supported by the arms.

The retaining part 11 exhibits basically the same construction and movement as the leg in the embodiment described in FIG. 1. The shock absorbing part 12 is a means arranged axially in relation to the retaining part 11 and can be displaced in relation to the direction of movement of the hoist. This is so that the shock absorbing part 12 can be displaced downward when the retaining part 11 is extended and convey forces from the hoist cage to the buffer.

The shock absorbing part 12 is accordingly mounted axially displaceable in the retaining part 11. Furthermore, it is so arranged that in an inactive state, it will protrude above the top of the retaining part for a distance corresponding to the stroke of the buffer and thereby corresponding to the maximum load that can be expected.

Furthermore, a spring or similar device can be arranged in an inactive state to keep the shock absorbing part in its initial raised position.

Figure 4:
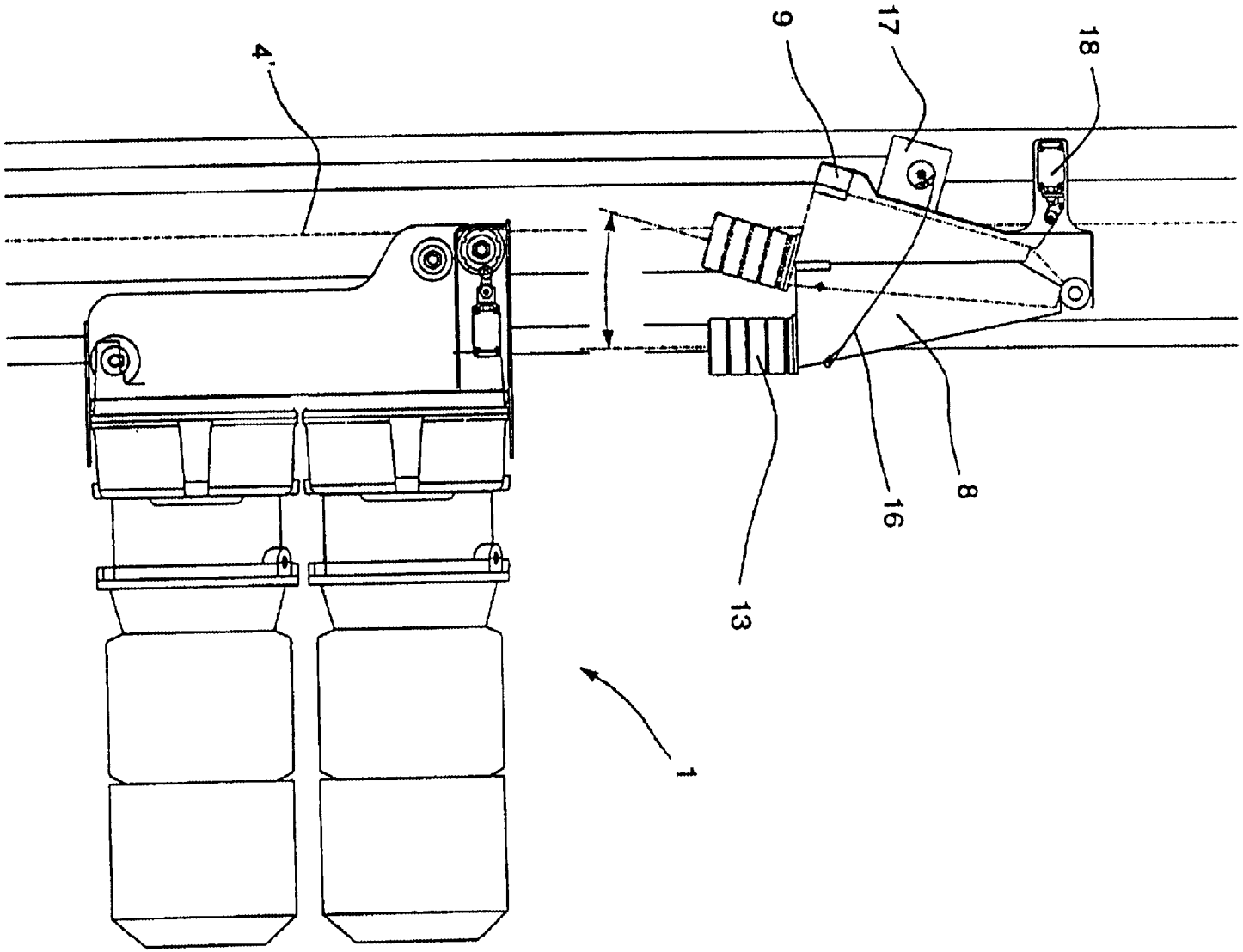
FIGS. 4 and 5 illustrate another upper part of the embodiment according to the present invention in two different views.
Figure 5:
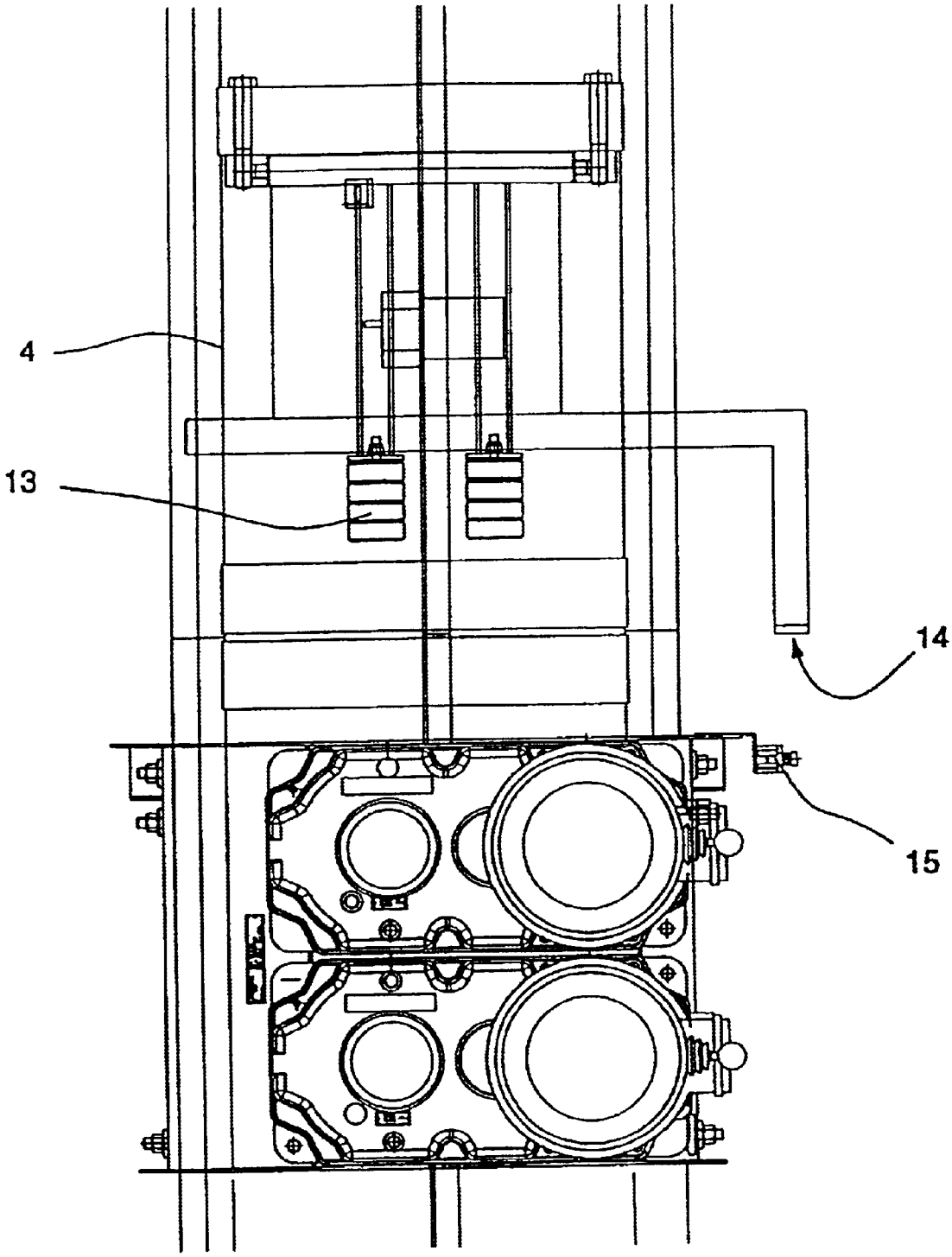

The upper means of limitation is illustrated in an additional embodiment in FIGS. 4 and 5. FIG. 4 shows a schematic of a hoist cage 1 travelling along a mast 4' and an upper means of limitation in the form of a frame-shaped projection 8 equipped with an expanded plastic buffer 13 on the surfaces that are intended to encounter the hoist cage.

Also arranged on the frame is a breaker cam 14, see FIG. 5, intended to interact when the means of limitation is in an active state with a limit switch 15 arranged on the hoist cage 1 in order to shut off the hoist drive at the new safety end limit.

Figure 6:
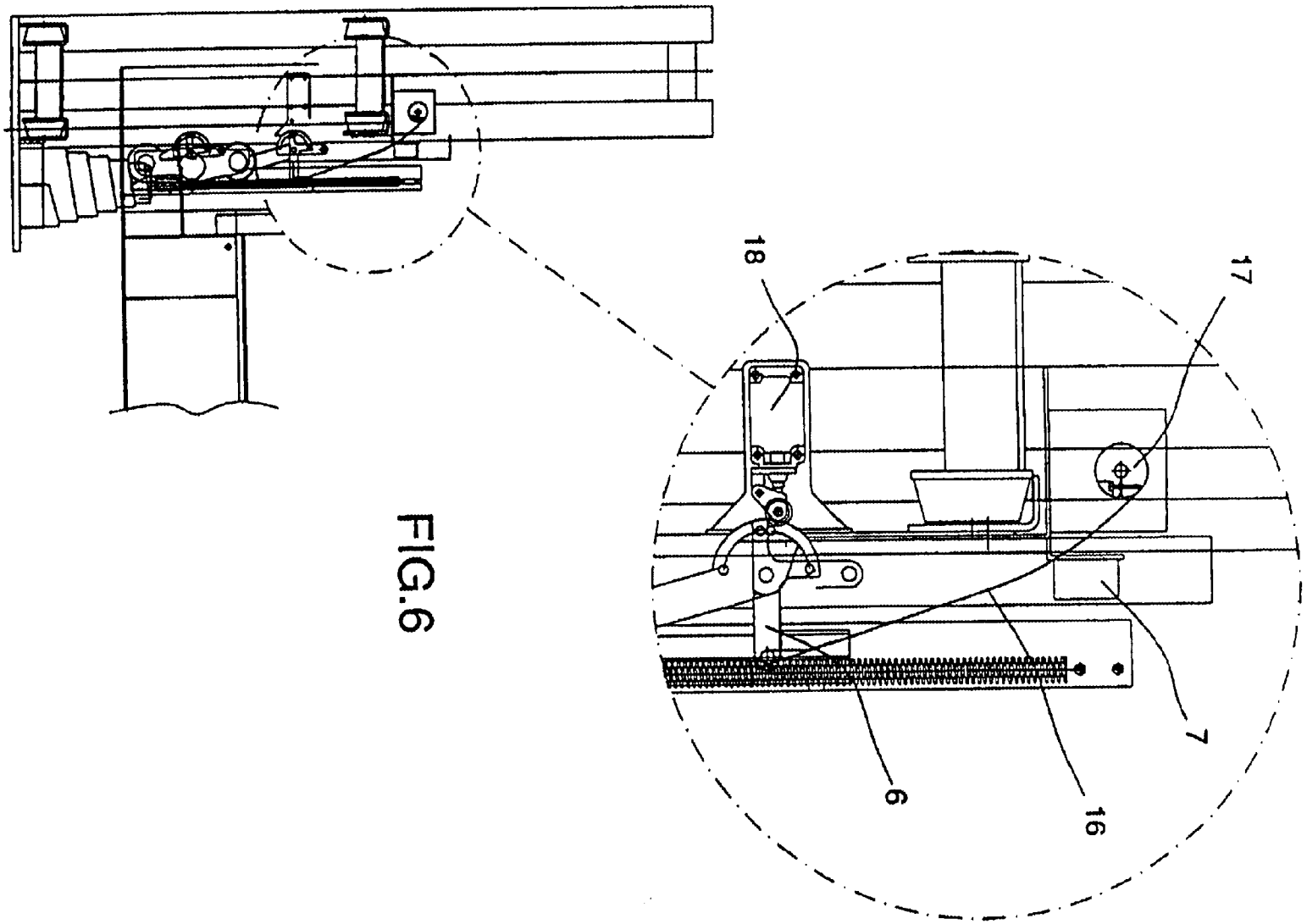
FIG. 6 illustrates a detailed large scale view of an embodiment according to the present invention.

In an additional embodiment, the means of limitation can be equipped with a means of return. One embodiment of such a means of return is illustrated in FIGS. 4 and 6, acting on the upper and lower means of limitation respectively. This means of return can comprise a leaf spring 16 arranged with one end on the means of limitation, e.g. the projecting frame 8, and the other end on the output shaft of a gear motor 17. When the motor 17 is activated, the leaf spring will be wound onto the motor shaft and be pulled in towards the retaining device. A limit switch 18, for example, can be used to indicate that this has taken place. Once the retaining device 9 has gripped the means of limitation 8, the motor 17 will be shut off. When the means of limitation is later released, the leaf spring will assist in returning it to its active state.

FIG. 6 illustrates the said embodiment of the means of return applied on the lower means of limitation in the embodiment illustrated in FIGS. 2 and 3.

What is claimed is:

1. An arrangement for a hoist having a hoist cage adapted to travel in a path in a hoist shaft, the arrangement secures safety zones in case persons should be outside the hoist cage in the hoist shaft and comprises:

(a) mechanical means of limitation that can enter into the path of the hoist cage arranged at a distance from upper and lower end limits of the hoist cage during normal operation in order to form upper and lower safety end limits and mechanically secure the safety zones, said mechanical means of limitation having at least one striking surface arranged to tilt between an inactive state outside the path of the hoist cage and an active state in the path of the hoist cage forming the safety end limits, the at least one striking surface balanced to take the active state and a retaining device arranged on each striking surface to keep the at least one striking surface in the inactive state during normal operation and to release the at least one striking surface in a risk situation to take the active state; and (b) means of return arranged to return the at least one striking surface from the active state to the inactive state, said means of return comprises an electric motor and a leaf spring arranged between the at least one striking surface and the motor, the leaf spring arranged to pull in the at least one striking surface against the retaining device when the leaf spring is wound up by the motor and the leaf spring, when the retaining device releases the at least one striking surface, will assist in returning the at least one striking surface to the active state due to a tendency of the leaf spring to return to a linear form.

2. Arrangement according to claim 1, further including a surface arranged on the at least one striking surface and intended to encounter a limit switch arranged on the hoist cage when the at least one striking surface is in the active state and through contact with the limit switch shuts off a drive to the hoist at a new safety end limit.

3. Arrangement according to claim 1, wherein the at least one striking surface interacts with a shock absorbing device when in the active state.

4. Arrangement according to claim 3, wherein the at least one striking surface includes a lower striking surface, the lower striking surface in the active state rests on the shock absorbing device arranged on a floor of the hoist shaft and conveys a shock absorbing action upon encountering the hoist cage.

5. Arrangement according to claim 4, wherein the lower striking surface is rotationally supported by two parallel tilting arms that govern movement between the inactive state and the active state.

* * * * *